US005325842A

United States Patent [19]

Beach et al.

[11] Patent Number: 5,325,842

[45] Date of Patent: Jul. 5, 1994

[54] DUAL MODE DOWNDRAFT GAS RANGE

[75] Inventors: Stanley H. Beach, Indianapolis; Paul Noel, Greenfield; Steve Schatz, New Palestine; John Harper; Virgil Montgomery, both of Indianapolis, all of Ind.

[73] Assignee: Maytag Corporation, Newton, Iowa

[21] Appl. No.: 968,159

[22] Filed: Oct. 29, 1992

Related U.S. Application Data

[63] Continuation-in-part of Ser. No. 919,710, Jul. 24, 1992, Pat. No. 5,213,091, and a continuation-in-part of Ser. No. 919,728, Jul. 24, 1992, Pat. No. 5,209,217.

[51] Int. Cl.[5] ..... F24C 3/00

[52] U.S. Cl. ..... 126/39 R; 126/39 K; 126/21 R; 126/299 R; 126/300; 431/354

[58] Field of Search ..... 126/21 R, 39 R, 39 J, 126/39 N, 39 H, 299 R, 299 D, 300, 39 K, 39 E; 431/286, 12, 266, 174, 354, 343; 55/DIG. 36

[56] References Cited

U.S. PATENT DOCUMENTS

| | | | |
|---|---|---|---|
| 2,870,829 | 1/1959 | Willaims | 158/113 |
| 3,162,237 | 12/1964 | Brown et al. | 158/99 |
| 3,169,871 | 2/1965 | Macchi et al. | 99/1 |
| 3,371,699 | 3/1968 | Riot | 158/119 |
| 3,468,298 | 9/1969 | Teague, Jr. et al. | 126/39 |
| 3,494,350 | 2/1970 | Perl | 126/39 |
| 3,592,180 | 7/1971 | Kweller et al. | 126/39 |
| 3,870,457 | 3/1975 | Perl | 431/66 |
| 3,968,785 | 7/1976 | Perl | 126/39 J |
| 4,020,821 | 5/1977 | Reid, Jr. et al. | 126/39 E |
| 4,409,954 | 10/1983 | Berlik et al. | 126/39 M |
| 4,413,610 | 11/1983 | Berlik | 126/39 K |
| 4,413,611 | 11/1983 | Berlik | 126/39 E |
| 4,457,293 | 7/1984 | Berlik | 126/39 N |
| 4,518,346 | 5/1985 | Pistien | 431/266 |
| 4,565,523 | 1/1986 | Berkelder | 431/354 |
| 4,569,328 | 2/1986 | Shukle et al. | 126/39 J |
| 4,570,610 | 2/1986 | Himmel | 126/39 |
| 4,622,946 | 11/1986 | Hurley et al. | 126/39 |
| 4,690,636 | 9/1987 | LeMonnier de Gouville et al. | 431/354 |
| 4,750,470 | 6/1988 | Beach et al. | 126/39 R |
| 4,757,801 | 7/1988 | LeMonnier de Couville et al. | 126/39 H |
| 4,773,383 | 9/1988 | LeMonnier de Gouville et al. | 26/39 R |
| 4,794,907 | 1/1989 | Corliss et al. | 126/39 R |
| 4,960,377 | 10/1990 | Nunes et al. | 431/12 |
| 4,971,024 | 11/1990 | Albon et al. | 126/39 B |
| 5,046,477 | 9/1991 | Bennett et al. | 126/39 B |
| 5,209,217 | 5/1993 | Beach et al. | 126/39 R |
| 5,213,091 | 5/1993 | Beach | 126/299 D |

FOREIGN PATENT DOCUMENTS

| | | |
|---|---|---|
| 1443553 | 7/1976 | United Kingdom . |
| 1543618 | 4/1979 | United Kingdom . |

*Primary Examiner*—James C. Yeung

*Attorney, Agent, or Firm*—Willian Brinks Hofer Gilson & Lione

[57] ABSTRACT

A novel dual mode, downdraft gas range provides a sealed top and sealed gas burners that can be operated effectively in a power burner mode with a downdraft exhaust and otherwise in an atmospheric mode. In the range, a separate and independently operating air/gas supply chamber for each sealed burner is supplied with a controllable flow of gas, and, in the power burner mode, with a controlled forced flow of primary combustion air from a combustion air blower and pressure-adjustable air plenum that supply all air/gas chambers, and each air/gas supply chamber is provided with a gated opening, which is operated to provide an unobstructed flow of primary combustion air from atmosphere in non-power burner operation. The mixture of air and primary combustion air flows from the air/gas supply chamber through a sealed conduit formed to be free of obstructions and abrupt changes in direction with a flow diffuser provided adjacent the gas burner. In the power burner mode, the air/gas mixture is combusted without being affected by the downdraft exhaust.

42 Claims, 6 Drawing Sheets

DUAL MODE DOWNDRAFT GAS RANGE

This patent application is a continuation-in-part of U.S. patent application Ser. Nos. 07/919,710, U.S. Pat. No. 5,213,091 and 07/919,728, both filed Jul. 24, 1992, U.S. Pat. No. 5,209,217.

FIELD OF THE INVENTION

This invention relates to gas ranges including a downdraft exhaust for the cooking surface and, more particularly, relates to a downdraft gas range including a dual mode, sealed gas burner system adapted for cooking with both a forced air-gas mixture and an atmospheric air-gas mixture.

BACKGROUND OF THE INVENTION

Gas ranges typically use atmospheric burners. Such atmospheric burners perform well when a plentiful supply of secondary air surrounds the burner. Typically, secondary air is supplied in such ranges through one or more aeration openings in the burner pan surrounding the burner body. In addition, secondary air is often supplied through a central opening in the burner. Such openings, however, create problems in the use of gas ranges because they permit spills, boilovers and the like to run from the top of the gas range into its interior, creating an undesirable cleaning problem.

Furthermore, combustion of any fuel, including natural gas and the other fuels that are used in household gas ranges, generally results in undesirable byproducts, such as carbon monoxide (CO) and oxides of nitrogen ($NO_x$). These pollutants are not direct products of perfect combustion but generally result from incomplete combustion and the presence of secondary air. Efforts to protect the environment have resulted in legislation and standards to limit permissible levels of such pollutants in both the United States and Europe, and it is expected that such legislation will become more widespread and that the resulting standards will become more stringent. It is clearly desirable to avoid the generation and distribution of such pollutants during the operation of gas ranges in the household of a user, and various apparatus have been proposed to reduce the generation and distribution of pollutants in the operation of gas burners.

As indicated above, it is desirable that the range top be sealed to preclude liquids and materials from entering the interior of the range. Some sealed, smooth-top gas ranges have included blowers or fans to produce both a flow of combustion air to, and an exhaust of combustion products from, burners that are located under a sealed glass or ceramic top of the range. See U.S. Pat. Nos. 2,870,829; 3,404,350; 3,870,457; 3,968,785; and 4,020,821. For example, U.S. Pat. No. 4,020,821 to Reid, Jr. et al., discloses a gas burning range with a sealed, smooth glass or ceramic top lying over a plurality of infrared burners. In the gas range of Reid, Jr. et al., a primary gas/air mixture is provided for each burner from a combined gas and air shutter valve to a burner tip for combustion. A blower creates a negative pressure in each burner and throughout the flow path for the fuel gas, draws a flow of additional air for combustion into the gas flow path, and creates an exhaust for the combustion products leaving the burners. Such sealed top ranges generally rely on infrared heating of cooking utensils through the sealed top and are thus not as thermally efficient or as fast as open flame ranges.

Sealed top gas ranges with open flame burners have been obtained by, for example, sealing the burner head to the top range surface or burner pan. The use of such "sealed burners" in gas range construction eliminates the openings through which secondary air reaches the burners, and the air needed for combustion must enter the combustion zone in a path which is below the existing products of combustion, and the performance of the range burners is vulnerable to a number of adverse effects. Among the problems presented by such open flame, sealed burner constructions are the recirculation of products of combustion, the tendency of the gas flames to "reach" for combustion air which distorts the flame pattern and detracts from even heat distribution, the destruction of flame patterns as a result of adjacent walls that interfere or divert the secondary air supply, and flame distortion created by the simultaneous operation of adjacent burners that compete for secondary air as their flames tend to be drawn toward the natural thermal updraft of the adjacent burners. Attempts to solve such problems have included high grate tops and other barriers seeking to prevent such burner interaction.

Gas ranges with downdraft exhaust systems are known, as shown, for example, by U.S. Pat. Nos. 4,413,610; 4,413,611; 4,409,954; 4,457,293; and 4,750,450.

The problems attendant sealed burners are compounded in gas ranges with downdraft exhausts. The purpose of the downdraft exhaust is, of course, to remove products of combustion and cooking vapors from the gas range during its operation by creating a flow of exhaust air across the top of the range adjacent the burners. The air flow from such a forced exhaust pulls the flames in the direction of the exhaust, interfering with the proper combustion and heat distribution at the burners. The air flow created by the downdraft exhaust means also pulls the secondary air away from the burner flames, and the disturbed flame cones impinge on relatively cold grate fingers to cause incomplete combustion. In some designs, heat from the burners of a downdraft gas range has been so unevenly distributed that it is not possible to evenly cook such food stuffs as pancakes, eggs and sausages in a large skillet. In addition, a low simmer flame cannot be satisfactorily stabilized and ignition of the flame becomes unreliable.

Prior efforts to combine open flame sealed burners with a downdraft exhaust have also used shields extending several inches above the burner to help protect the burner flame from the exhaust flow. Other attempts have elevated the entrance to the downdraft exhaust plenum several inches above the cooktop in an effort to minimize the adverse effect of the exhaust at the cooktop surface. In still further efforts, the downdraft exhaust has been reduced in power, or the entrance to the downdraft plenum has been remotely located from the burners, or has been reduced in intake area, in attempts to minimize the adverse effect of the exhaust. Each of these methods, however, detracts from the effectiveness of the downdraft exhaust and reduces its ability to capture and remove cooking vapors, odors, heat and other products of combustion and cooking.

The use of powered gas burners in gas cooking ranges has been disclosed in the art. For example, U.S. Pat. No. 3,468,298 to Teague, Jr. et al. discloses a sealed, smooth-top gas range with a plurality of powered infrared burners. In the gas range of Teague, Jr. et al., a blower supplies air to and pressurizes a manifold extending along the front of the range. The manifold has openings formed in its bottom, one for each of the plurality of burners. A slide valve for each burner includes air control orifices cooperating with a manifold opening for each burner to permit a variable and controllable flow of combustion air from the manifold through a venturi mixer to its associated burner. Gas flow to the venturi mixer and burner is controlled by a diaphragm-operated gas flow regulator, which is operated by the air pressure in the valve manifold to control the gas/air mixture to each burner.

U.S. Pat. No. 4,569,328 to Shukla et al. seeks to avoid emission of air pollutants, such as carbon monoxide and oxides of nitrogen, into the kitchen. The Shukla et al. patent discloses a gas range with a ceramic tile forming a plurality of openings provided, preferably, with a forced air-gas mixture and adapted to provide an open standing flame close to its upper surface so that the ceramic tile burner will provide high radiant heat as a result of the gas flame. In Shukla et al.'s invention, a jet plate is positioned between the infrared burner and the supporting surface for the cooking utensil. The jet plate is stated to be of considerable importance in the achievement of high thermal efficiencies. Shukla et al.'s jet plate includes a plurality of perforations or jet holes to form high velocity gas jets from the combustion products of the infrared burner, and the gas jets are directed to impinge against and convectively heat the lower surface of the cooking utensil and then pass into the atmosphere of the kitchen above the cooktop.

While Shukla et al. discloses that his ceramic tile may operate as an atmospheric burner, in Shukla et al.'s preferred embodiment, a blower is positioned in the central portion of the range to pressurize an air plenum, which is linked to a plurality of mixing valve assemblies to control the flow of the forced air-gas mixture to the plurality of burners. Each mixing valve assembly provides a selected stoichiometry for its associated burner by mechanically coupling a rotatable air orifice plate to a gas valve shaft so that by rotation of the gas valve shaft to control gas flow, air flow is simultaneously controlled by the alignment of one or more of several discrete openings in the air orifice plate with a fixed opening in an air flow tube.

U.S. Pat. No. 4,960,377 to Nunes et al. discloses a gas-air mixing valve for use with residential and commercial cooking ranges. The Nunes et al. valve is designed for use preferably in a gas range having a plurality of gas burners. The Nunes et al. valve is attached to an air plenum which is pressurized by an air blower. The Nunes et al. valve is adapted to be mounted over a hole formed in the air plenum and to provide two valve openings communicating with the interior of the air plenum, one of the valve openings forming an inlet to an air-gas mixing chamber within the valve, and the other valve opening communicating with atmosphere. The two valve openings to the pressurized air plenum formed by the Nunes et al. valve are covered by a rotating orifice plate. The rotating orifice plate includes an opening cooperating with the opening between the air plenum and the air-gas mixing chamber, and an opening cooperating with the opening to atmosphere so that as the size of the entrance to the air-gas mixing chamber is increased by rotation of the orifice plate, the size of the opening between the air plenum and atmosphere is correspondingly decreased to maintain a constant air flow in the plenum for the operation of each of the gas burners. As the orifice plate is rotated, the gas valve is also operated to maintain a selected forced air-gas mixture to each cooking burner.

Other arrangements of gas ranges with power burners, and air/gas control valves for gas ranges with power burners are disclosed in U.S. Pat. Nos. 3,162,237; 3,169,871; 3,371,699; 3,592,180; 4,622,946; and 4,794,907. Notwithstanding these various developments, the use of powered surface burners is rare in household gas ranges. Variations in the characteristics and burning properties of gas from utility to utility and locale to locale have made it difficult to achieve reliable and repeatable combustion characteristics with powered surface burners in a household range.

Other patents disclosing sealed burners include British Patent Nos. 1,443,553; and 1,543,618; and U.S. Pat. Nos. 4,518,346; 4,565,523; 4,570,610; 4,690,636; 4,757,801; 4,773,383; 4,971,024; and 5,046,477.

Notwithstanding the efforts of others, no one, prior to this invention, has provided a dual mode gas range with the combined advantages and abilities of a sealed top construction, downdraft exhaust and open flame gas burners that are operable with a powered gas/air mixture with a downdraft exhaust, and otherwise as an atmospheric range.

SUMMARY OF THE INVENTION

The invention provides a thermally efficient sealed gas range with a downdraft exhaust combined with an open flame gas burner that limits the generation of CO and $NO_x$, is substantially immune to the adverse effects of the downdraft exhaust and of adjacent walls, and provides even heat distribution with and without the downdraft exhaust. Gas ranges of the invention feature good combustion, ignition and re-ignition with low levels of generated CO and $NO_x$, a high turndown ratio with a stable low flame setting, a high thermal efficiency at least equal to existing atmospheric gas ranges, a large entrance to the downdraft exhaust substantially flush with the cooktop and located effectively adjacent the burners, freedom from surface barriers or shields which inhibit the effectiveness of the downdraft exhaust, and immunity from adjacent walls, providing greater freedom in installation of the range.

The invention provides a gas range including a top surface adapted to be sealed with one or more gas burner assemblies, and a downdraft exhaust adjacent the one or more gas burner assemblies adapted to draw cooking vapors, heat and the products of combustion and cooking from adjacent the surface of the range and the gas burner assembly. Gas ranges of the invention further provide dual modes of operation in which the one or more sealed gas burner assemblies can be effectively operated as both atmospheric and powered burners. Each sealed gas burner assembly comprises a gas burner connected through a sealed conduit with a combined air and gas supply controller. The combined air and gas supply controller comprises a chamber enclosing an air-gas mixer that is connected through a gas flow control valve with a source of gas under pressure. The chamber is also connected with either a combustion air blower through an air flow control valve or with atmosphere through a gated opening. A control for the gas range of the invention provides the dual mode of operation with either powered operation or atmospheric operation of the one or more sealed burner assemblies.

In preferred gas ranges operating in the power burner mode, the gated opening remains closed and the downdraft exhaust blower and combustion air blower are controlled so that the combustion air blower for powered burner operation is available whenever the downdraft exhaust blower is operated. Preferably, the combustion air blower operates or is operated to establish its flow of combustion air prior to the establishment of the downdraft exhaust by the downdraft exhaust blower. With the downdraft exhaust operating, each of the sealed burner assemblies is provided, by the combustion air blower with a flow of primary combustion air through the air flow control valve of its combined air and gas supply controller, and the controlled flow of primary combustion air is directed into the chamber of its combined air-gas supply controller where the air becomes mixed with a controlled flow of gas from its gas flow control valve, and the resulting forced air-gas mixture is directed through the sealed conduit leading to the burner assembly. Preferably, each of the sealed burner assemblies is provided with a diffuser between the sealed conduit and the burner outlets to quiet and stabilize burner operation in the powered mode.

In preferred gas ranges operating in the atmospheric mode, the gated opening is opened to atmosphere and the downdraft exhaust is disabled. Each of the sealed burner assemblies is provided, from atmosphere, with a flow of primary combustion air through the gated opening to the chamber of its combined air and gas supply controller where the air becomes mixed with a controlled flow of gas from its gas flow control valve, and the resulting air-gas mixture is directed through the sealed conduit leading to the burner assembly. Preferably, the sealed conduits for the dual mode gas range are formed to eliminate abrupt, flow impeding changes in direction, with minimum radii of their bends being greater than about an inch and preferably about two inches or greater.

Preferred dual mode gas ranges include a plurality of sealed burner assemblies and a pressurizable air plenum connected with the combustion air blower which, when powered, supplies the air plenum with air at a pressure slightly above atmospheric pressure. In preferred multi-burner embodiments, a plurality of combined air and gas supply controllers, one for each sealed burner assembly, are carried within the air plenum. Each air and gas supply controller includes an air flow control opening between its chamber and the air plenum, to permit a forced flow of primary combustion air from the air plenum into the chamber of the combined air and gas supply controller for mixing with gas and delivery to its sealed burner. The actuator for each gas flow control valve of each combined air and gas supply controller is provided with a shaped air flow control cam, which is located adjacent the air flow control opening between the air plenum and its chamber, and each actuator thus permits simultaneous control of the rate at which primary combustion air enters the chamber from the air plenum and the rate at which gas is introduced into the chamber for mixing and delivery to each sealed burner assembly. In such preferred multi-burner embodiments of the invention, each of the plurality of chambers is provided with a gated opening which is closed in the powered burner mode with the combustion air blower in operation, and opened in the atmospheric air mode.

In preferred dual mode, multi-burner gas ranges of the invention, one side of the pressurizable air plenum is formed by one side of a burner box that carries the sealed top and the plurality of sealed gas burner assemblies, and the plurality of chambers for the plurality of combined air and gas controllers are formed in one or more injection boxes that have an open face adapted for sealed engagement with the side of the burner box shared by and forming in part the pressurizable air plenum, and the side of the burner box shared with the pressurizable air plenum is provided with a plurality of gated openings for atmospheric operation, each gated opening communicating with one of the chambers formed in the injection boxes. In this preferred structure, the burner box can carry one or more air gates for opening and closing the gated openings for atmospheric air in the side of the burner box. In addition, the one or more injection boxes forming the chambers of the combined air and gas controller can be arranged in a line, along the side of the burner box that is provided with the plurality of gated openings for atmospheric air, and the burner box can carry a single air gate operable for simultaneously, and preferably slowly, opening and closing the plurality of gated atmospheric air openings, for atmospheric or powered burner operation, respectively.

Such preferred dual mode, multi-burner gas ranges of the invention include an open top burner box formed by a bottom, two sides and two faces with the range top attached to the open top of the burner box and sealed to the plurality of sealed gas burners to provide a sealed-top gas range assembly. As noted above, the supply of gas and air to the plurality of sealed gas burner assemblies is provided through a plurality of sealed conduits extending between the sealed gas burner assemblies and the combined air and gas supply controllers at the side of the burner box shared by and forming the air plenum. In such preferred gas ranges, the combustion air blower has its inlet connected with an opening formed in the bottom of the burner box and communicates with the enclosed but unsealed space formed between the range top and the bottom, sides and faces of the burner box, and the outlet of the combustion air blower communicates with the air plenum, which, as indicated above, is formed in part by the wall shared with the burner box. The side of the burner box shared with the air plenum also includes a circulating air opening that communicates with the enclosed but unsealed space formed between the range top and the bottom, sides and faces of the burner box. The air plenum and the enclosed but unsealed space within the burner box comprise a circulating path of air flow generated by the combustion air blower, and a plurality of air flow paths for primary combustion air generated by the combustion air blower are formed by the air plenum, the sealed conduits and sealed gas burner assemblies. The side of the burner box shared with the air plenum carries an adjustable shutter for adjustably closing the circulating air opening, thereby adjusting the air plenum pressure available to direct primary combustion air flow through the plurality of air flow paths to the plurality of sealed burners in the powered mode of operation.

The combined air and gas supply controllers supply, in the powered mode, controlled flows of gas and of primary combustion air in excess of atmospheric pressure from the air plenum to each of the sealed burner assemblies for cooking with a downdraft exhaust, and in the atmospheric mode, controlled flows of gas and primary combustion air at atmospheric air pressure from the enclosed but unsealed space within the burner box for cooking without a downdraft exhaust.

The invention provides a method of cooking with gas and a downdraft exhaust by directing a controllable flow of combustion air and a controllable flow of gas through an air-gas mixer, mixing the controllable flows of combustion air and gas to provide a directed combustible flow of air and gas through a sealed conduit to a gas burner, controlling the flows of combustion air and gas to provide a controlled variable combustion of gas at the gas burner, combusting the directed flow of combustion air and gas from the gas burner for cooking, and exhausting the byproducts of gaseous combustion and cooking by providing a downdraft adjacent the gas burner. In the invention, the powered flow of primary combustion air and gas flow are provided from within each of the plurality of burner outlets to form combusting gas-air jets with rapid, substantially complete combustion close to the burner outlets, in short stable flames which are unaffected by the downdraft exhaust and other outside influences and provide even heat distribution for cooking. The invention also provides a non-powered, atmospheric cooking method by disabling the downdraft exhaust and providing a substantially unrestricted flow of air from atmosphere for mixing and direction through the sealed conduit to the gas burner for combustion and cooking.

Other features and advantages of this invention will be apparent from the drawings and more detailed description that follow.

BEST MODE OF THE INVENTION

Figure 1:
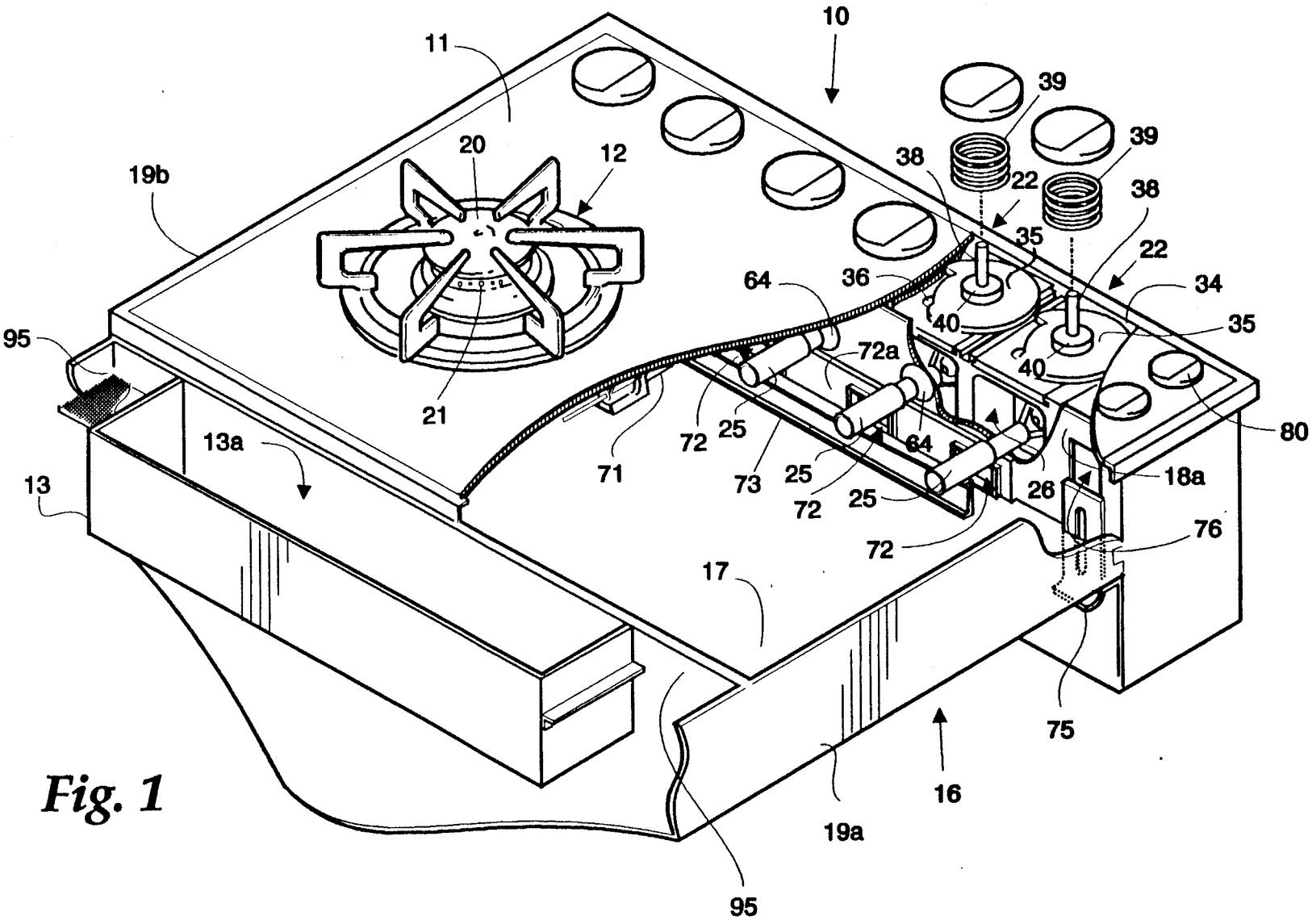
FIG. 1 is a partially broken away, perspective view of a multi-burner, dual mode, downdraft exhaust gas range of this invention.
Figure 2:
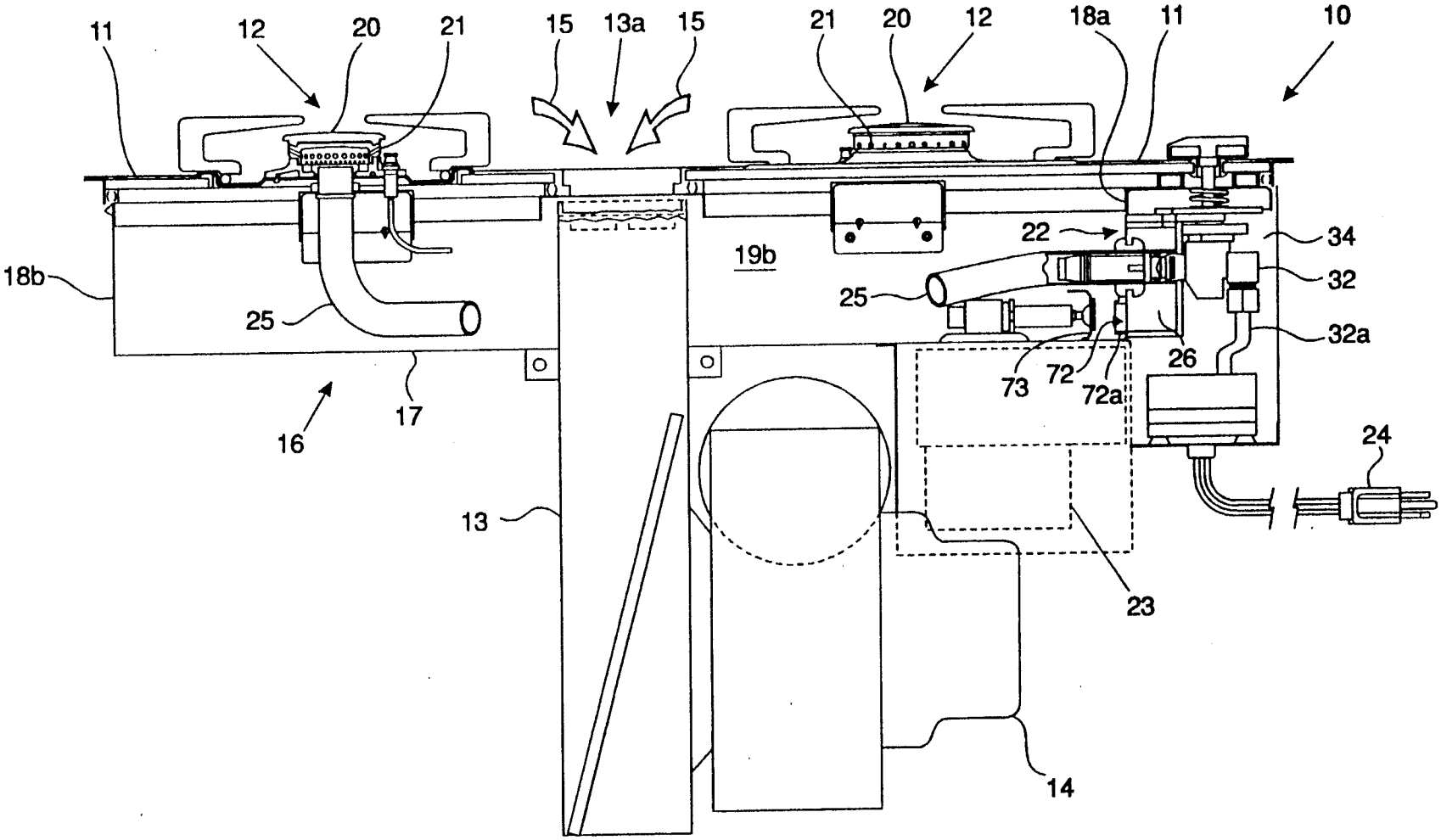
FIG. 2 is a cross-sectional view of the gas range of FIG. 1 taken generally at a vertical plane through the burner at the left and omitting the details of the burners at the right for clarity.
Figure 3A:
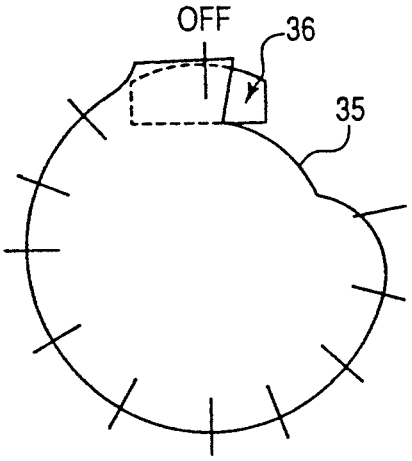
FIG. 3A is a simplified view of the air flow control plate and air flow orifice of the combined air and gas supply controller of FIG. 3.
Figure 3:
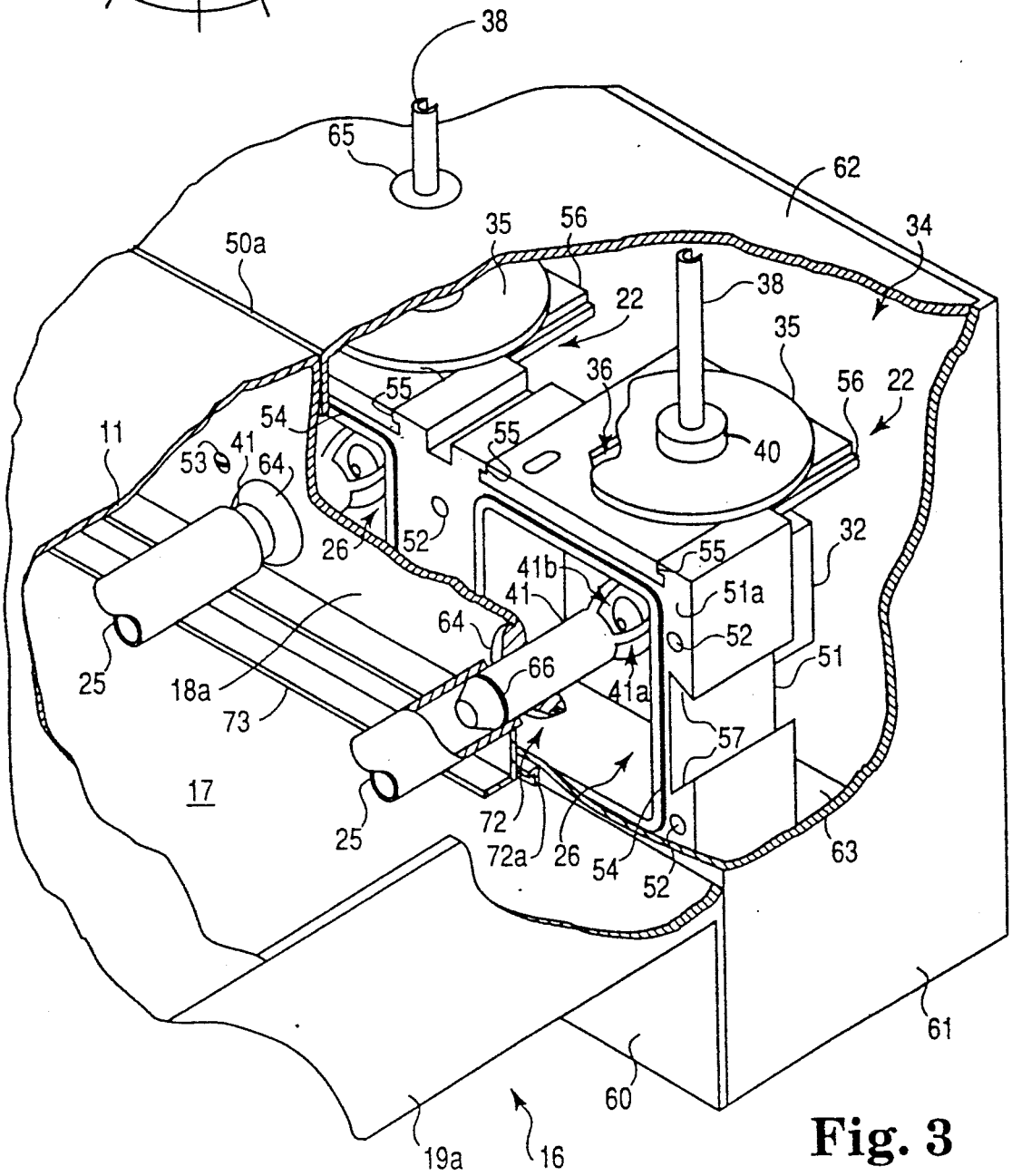
FIG. 3 is a partially broken away, perspective view of a preferred combined air and gas flow controller of this invention.

FIGS. 1 and 2 illustrate a preferred downdraft gas range of this invention. As shown in FIGS. 1–3, the gas range 10 includes a cooktop having a top surface 11 adapted to be sealed to one or more gas burner assemblies 12. The range top 11 is adapted to be fastened to the open top of a burner box 16 formed by a bottom 17, a pair of sides 18*a* and 18*b*, and a pair of faces 19*a* and 19*b*, as shown in FIGS. 1–3, 4A and 4B. The range further includes a downdraft plenum 13 which is carried centrally within the burner box 16 with an exhaust opening 13*a* adjacent to burner assemblies 12. The downdraft plenum 13 is connected with an exhaust blower 14, as shown in FIG. 2, and when the exhaust blower 14 is operating the downdraft plenum withdraws air and cooking vapors from adjacent of top surface 11 and gas burner assembly 12 of the range, as indicated by arrows 15 of FIG. 2.

The sealed gas burner assemblies 12 each include a gas burner 20 having a plurality of burner outlets 21, a combined air and gas flow supply controller 22 adapted for connection to a source of air under pressure in the powered mode and to atmospheric air in the atmospheric mode, and with the source of gas, as described in more detail below. In the powered mode, the source of air under pressure comprises a combustion air blower 23, providing primary combustion air to the combined air and gas supply controller 22 through an air plenum 34. A sealed conduit 25 is connected between each gas burner assembly 12 and its combined air and gas flow supply controller 22, as shown in FIG. 2. The combined air and gas flow supply controller 22 includes a plenum-forming chamber 26, means including injection mixers 41 for mixing the flows of air and gas and means including gas control valves 32, air flow control plates 35, air flow control openings 36 and actuator shafts 38 for controlling the air flow and the gas flow to provide a combined and controlled flow of air and gas through the conduit 25 and the gas burner outlets 21 for controllable combustion. The combined air and gas flow supply controller 22 is shown and described in greater detail with respect to FIG. 3.

FIG. 3 is a partially cut-away, perspective view of a preferred embodiment of the combined air and gas supply controller 22 which is adapted for manufacture and for use in a household downdraft gas range of the invention. The structure shown in FIG. 3 is adapted for a gas range with a plurality of gas burners and the elements of the FIG. 3 embodiment that correspond to the elements illustrated in FIGS. 1 and 2 carry the same element numbers.

In the structure shown in FIG. 3, the range top surface 11 (partially broken away) which carries a plurality of gas burners 20 is fastened to a sheet metal weldment which forms a burner box 16 and houses a plurality of sealed conduits 25 which lead to the plurality of gas burners 20 (not shown in FIG. 3) sealed to range top 11. The chamber 26 of the combined air and gas supply controller 22 forms, in effect a plenum having a volume in the range of about 7 to about 8 cubic inches for each of the plurality of gas burners 20, and the plenum-forming chamber 26 may be formed by an injection box 51. For ease of assembly, the injection box 51 may be molded to form a plurality of plenum-forming chambers 26 so that when the injection box 51 is fastened to the side wall 18*a* (partially broken away) of the burner box 16, as indicated in FIG. 3, it forms a chamber, or plenum, 26 for each of the gas burners 20. As indicated in FIG. 3, the injection box 51 may be molded to include a plurality of bores 52 to permit it to be fastened to the burner box 16 by screws 53 as indicated in FIG. 3. The injection box 51 may also be formed with channels 54, one surrounding each plenum-forming cavity 26, in the face 51*a* which mates the side 18*a* of the burner box 16. The channels 54 are adapted to carry O-ring seals so that upon assembly of the injection box 51 to the side wall 18*a* of the burner box 16, the plenum-forming cavities 26 are sealed.

In addition, as shown in FIG. 3, the top of the injection box 51 may be provided with a plurality of tongue and grooved portions 55 to permit a mating plate 56, which includes an air flow control opening 36 into each plenum-forming chamber 26, to be inserted into and carried by the injection box 51. By providing each sealed burner assembly 20 with a separate plenum-forming chamber 26 with a substantial volume of about 5 to 10 cubic inches, and preferably about 7–8 cubic inches, in the flow path for its air-gas mixture, variations in the operation of the sealed burner assemblies are effectively isolated from one another. That is, a change in operation of one sealed burner assembly can be isolated from and will not significantly affect another operating burner.

By molding the injection box 51, it may be economically provided with a number of other features, such as formed grooves 57 and tongues (not shown) in their sides so that each injection box 51 can be molded with a pair of plenum-forming cavities 26, but can provide tongue and groove assembly with another injection box 51, end-to-end in a row, permitting simple assembly for gas ranges with 2, 4 and 6 gas burners. Thus, in preferred embodiments of the invention, the plurality of combined air and gas supply controllers 22 can be conveniently arranged in line at one side (e.g., 18*a*) of the range burner box 16 in numbers corresponding to the number of range burners.

As indicated in FIG. 3, the one or more injection boxes 51 forming the plenum-forming chambers 26 are carried within a large air plenum 34 which is formed by a plurality of sheet metal wall portions carried by the burner box 16. For example, the large air plenum 34 can be formed by a partial side wall 60 adjoining burner box side wall 18*a*, a length of sheet metal is formed to provide side and back walls 61, and a sheet metal bottom 63. A separate sheet metal top 62 is also provided to complete the air plenum 34. The air plenum 34 is connected with the combustion air blower 23 (see FIGS. 2 and 4), and the air pressure within the plenum 34 can be maintained slightly above atmospheric air pressure by the blower 23 (for example, about 0.3 to 0.5 inches of water column pressure above atmospheric pressure) as described below. Each plenum-forming injection box 51 is carried within the air plenum 34 by side wall 18*a* of burner box 16, and the injection box 51 carries at its back a plurality of gas control valves 32 which are also within the air plenum 34. The gas flow control valves 32 are connected from within the air plenum 34 to a gas flow source (not shown) by conduits 32*a*, as indicated in FIG. 2. Gas flow to the gas burners 20 is varied by rotating the actuator shafts 38 for the gas flow valves 32. As indicated in FIG. 3, an air flow control plate 35 is carried on each of the actuator shafts 38 immediately adjacent the plate 56 forming the air flow control orifice 36. As shown in FIG. 3A, the air flow control plates or cams 35 have cam-like shapes of varying outer radii which are adapted to coact with the cooperatively shaped air flow openings or orifices 36 and provide variably-sized air flow openings and controlled air flows into the plenum-forming chambers 26 to provide a stable effective combustion at the burners of the variable gas flow, which is controlled by gas flow control valve 32 as a result of adjustment of the common actuator shaft 38.

Figure 4A:
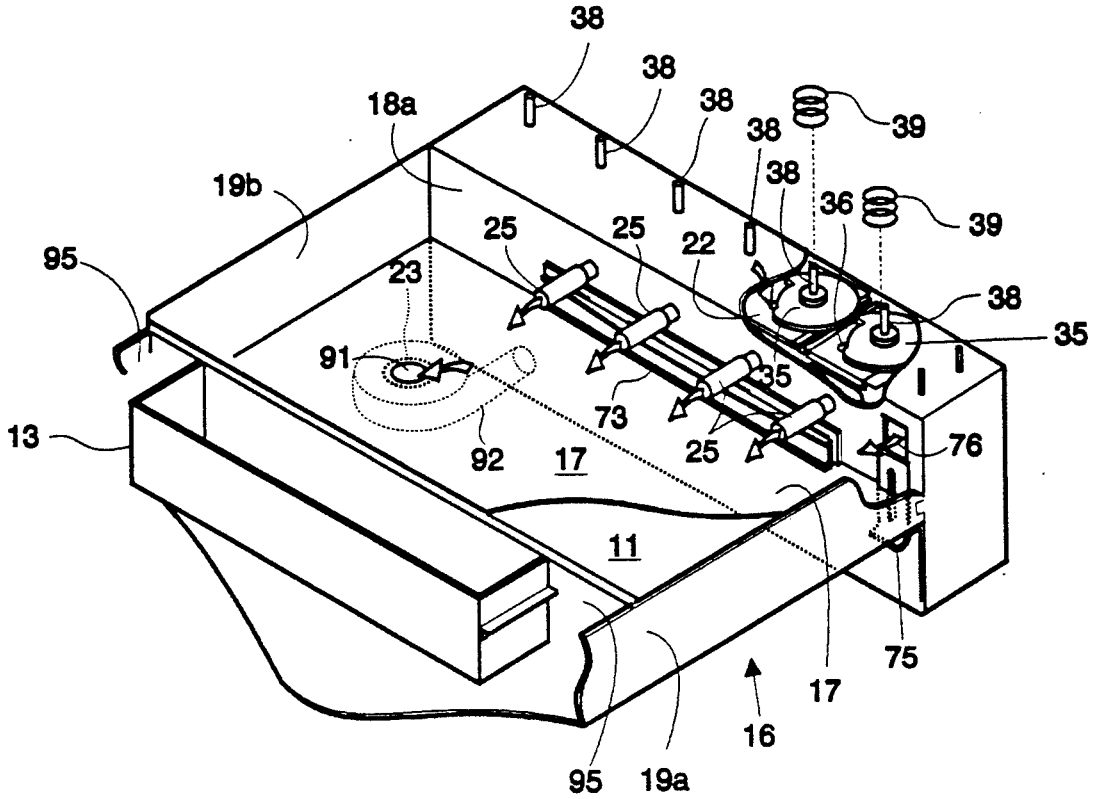
FIG. 4A is a perspective view, partially broken away, of the gas range of FIGS. 1 and 2 to illustrate the flow paths for primary combustion air when the gas range is operated in the powered mode.

As best shown in FIGS. 1, 2 and 4A, compression springs 39 are mounted in coaxial relationship with each actuator shaft 38 and overlie the air flow plates 35 with the inside diameter of the springs 39 being centered on the raised shoulders 40. The springs 39 are compressed by the top 62 of air plenum 34 to hold the air flow control plates 35 flush with the top of plates 56 and in proper position relative to air flow control openings 36.

As shown in FIGS. 1–3, side wall 18*a* of burner box 16 includes a plurality of gated openings 72, with each gated opening 72 interconnecting one of the plenum-forming chambers 26 formed by injection boxes 51 with the space between range top 11 and the burner box 16. The plurality of gated openings 72 may be conveniently formed in a separate sheet metal element 72*a* with protruding, easily sealed peripheries around each gated opening 72. The gated openings 72 are closeable by a gasketed air gate 73 moved by an actuator 71.

In the invention, controlled flows of gas and primary combustion air are to be directed into the plenum-forming chambers 26. The primary combustion air enters chamber 26 either through air flow control opening 36 in the powered mode or through gated opening 72 in the atmospheric mode, flows through openings 41*a* and 41*b* of injection mixers 41 for mixing with the gas flowing through gas flow control valve 72 and direction through the sealed conduits 25 to the gas burners 20.

As indicated in FIG. 1, the gas range is provided with an electrical control. Through the operation of knob 80 (or, if desirable, a lever), the operator of the gas range can operate the range with a downdraft exhaust and powered burners, or without a downdraft exhaust in an atmospheric mode. The electrical control is adapted to switch electricity from electrical connection 24 to close the gated openings 72 to the chambers 26 of the sealed gas burners 20 and to operate combustion air blower 23 and exhaust blower 14 (FIG. 2) together in the power mode.

In the preferred embodiment of the invention, combustion air blower 23 has less inertia, for example, by having a rotor with a smaller diameter and/or with less weight, and accelerates faster than downdraft blower 14 so that primary combustion air and gas will be delivered to the burners 20 for combustion in the absence of any significant exhaust, and the downdraft exhaust will not interfere with flame formation upon ignition. Because of the slower acceleration of the larger and/or heavier downdraft blower, the flow of exhaust air at the burners can be low enough to have negligible effect on flame formation. The electrical control operates a linear actuator 71, which moves an air gate 73 between positions closing the plurality of gated openings 72 in the power mode and opening the plurality of gated openings 72 when not powered. In the event of an electrical power failure, the gated openings 72 will assume their normally open postures, and the preferred gas range of this invention can be operated in an atmospheric mode.

As indicated in FIGS. 2 and 3, the air plenum 34 may be sealed at the openings provided for actuator shafts 38 with the plurality of grommets 65, the injector openings provided in the wall 18*a* of the burner box 16 may be sealed against the plurality of injector mixers 41 by grommets 64, and the injector mixers 41 may be sealed with the sealed conduits 25 by an O-ring seal 66 carried by the injector mixers 41.

As noted above and as indicated in FIGS. 4A and 4B, primary combustion air to each burner is introduced into the chambers 26 of the combined air and gas flow supply controller 22 by different paths in the powered mode and atmospheric mode of operation of the gas range.

When the range is operated in the powered burner mode, actuator 71 is operated to close the plurality of gated openings 72 with air gate 73, combustion air blower 23 is operated to supply air to and pressurize air plenum 34 and exhaust blower 14 is operated to exhaust combustion and cooking byproducts. In the powered burner mode, a substantial portion of the combustion air needed is provided through the sealed conduits 25 to the burners 20, as shown in FIG. 4A. As shown in FIGS. 2 and 4A, combustion air blower 23, which is a small fan or centrifugal blower, supplies a flow of primary combustion air to air plenum 34, shown in FIGS. 1-4A, which is maintained at a pressure slightly above atmospheric pressure, for example, about 0.3 to about 0.5 inches of water column pressure above atmospheric pressure. The air pressure within air plenum 34 may be varied by an adjustable shutter 75 which variably closes a circulating air opening 76 in one of the walls (e.g., 18*a*) forming the air plenum 34, as shown in FIGS. 1 and 4A. Shutter 75 may be adjusted at the factory or upon installation of the range to accommodate different operating conditions, as, for example, may be experienced when the gas range of the invention is installed at elevated altitudes with lower atmospheric pressures and air densities.

Figure 4B:
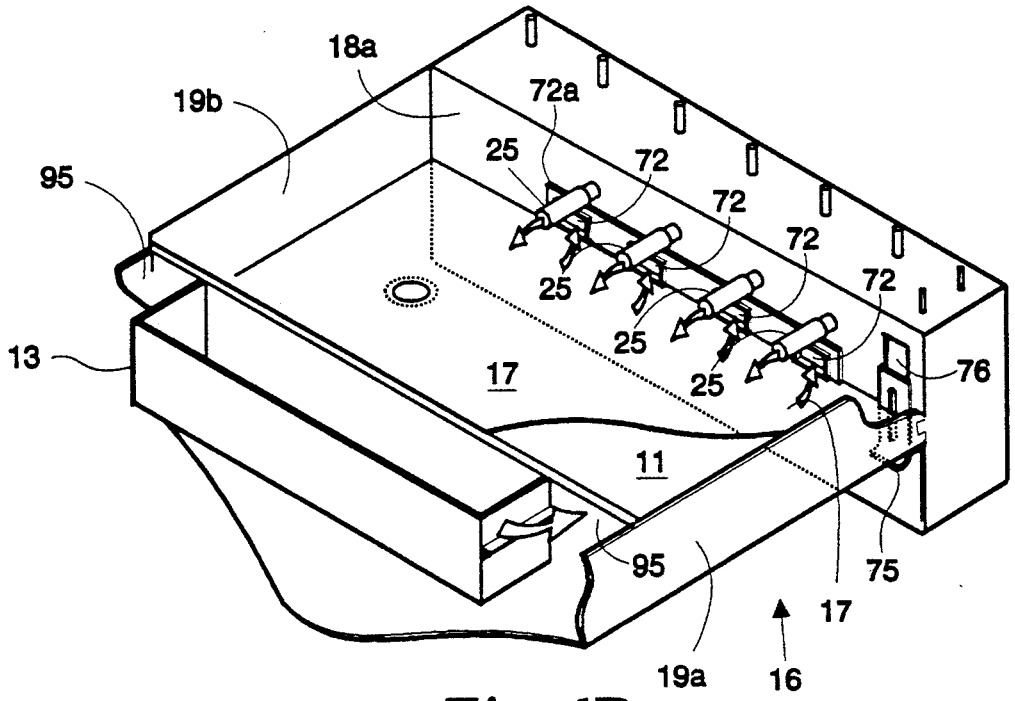
FIG. 4B is another perspective view of the same portion of the gas range as FIG. 4A to illustrate the flow paths for primary combustion air when the gas range is operated in the atmospheric mode.
Figure 5A:
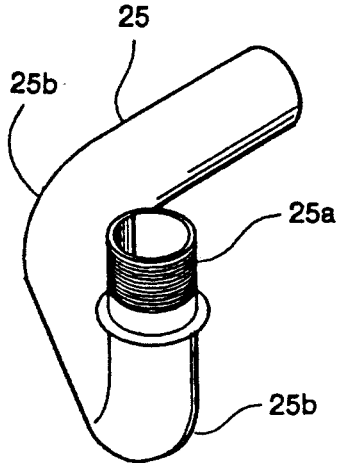
FIGS. 5A–5D illustrate the preferred sealed conduits of the gas range of FIGS. 1–4 that extend between the combined air and gas supply controllers and the sealed burner assemblies.
Figure 5B:
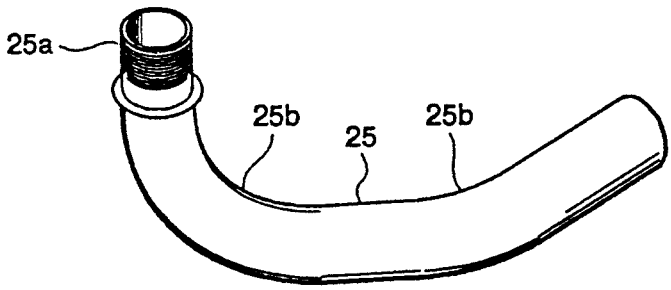
Figure 5C:
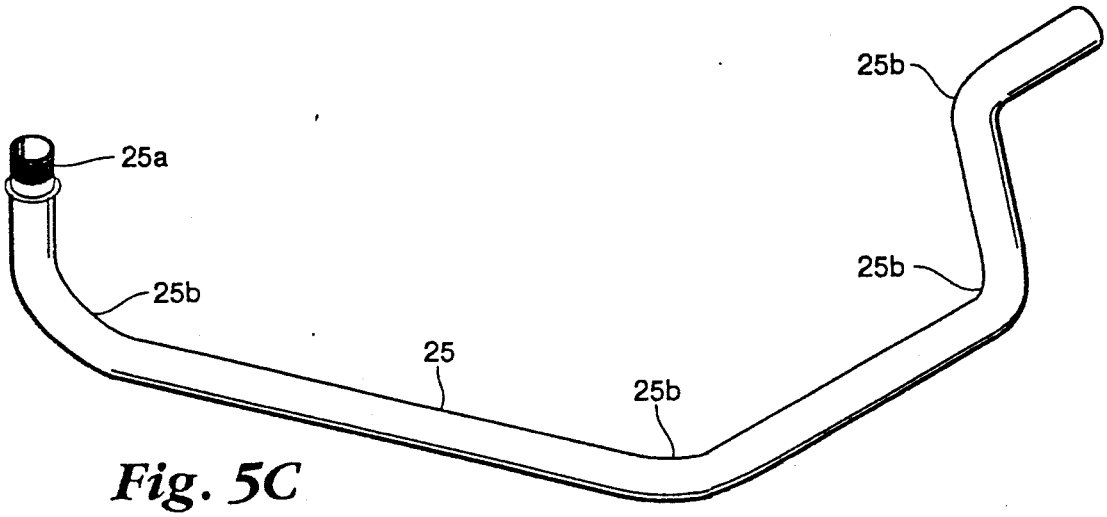
Figure 5D:
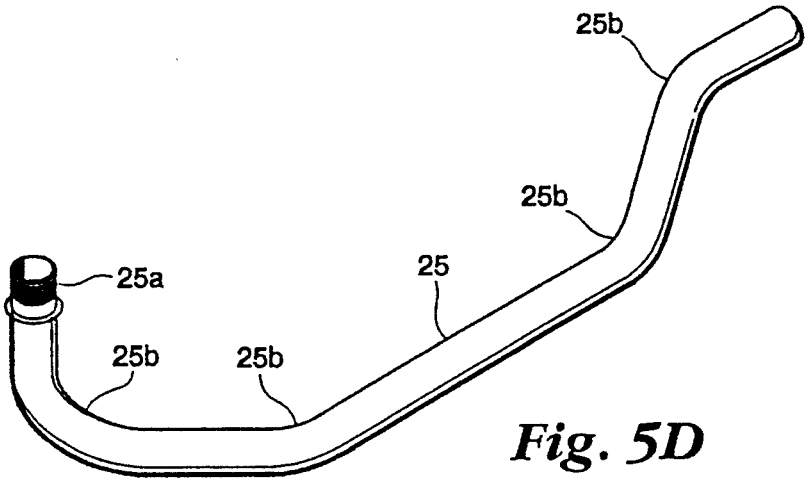

When the range is operated in the atmospheric mode, actuator 71 and blowers 14 and 23 are disabled, and primary combustion air is supplied to the burners 20 through the gated openings 72 and the plurality of chambers 26 of the combined air and gas supply controllers 22, as shown in FIGS. 1 and 4B, and the burners draw secondary combustion air from adjacent the range top. Air gate 73, which is shown in FIGS. 1-3 and 4A, is not shown in FIG. 4B for simplification of FIG. 4B. FIGS. 3 and 4A show the air gate 73 in the closed position, while FIGS. 1 and 2 show the air gate 73 in the open position. The actuator 71 for air gate 73 that controls the flow of atmospheric combustion air through the gated openings 72 to the burners 20 is preferably a thermal linear actuator which opens and closes the gated openings 72 slowly to avoid disturbance of the burner flames. One such linear actuator is sold by Design and Manufacturing Corporation of Willoughby, Ohio.

As indicated above, the gas range 10 is formed by an open top burner box 16 having a bottom 17, two sides 18*a* and 18*b* and two faces 19*a* and 19*b* and a range top 11 fastened to the open top of the burner box 16 and carrying a plurality of gas burners 20 (not shown in FIGS. 4A and 4B) sealed to the range top 11. The range top 11, and the bottom 17, sides 18*a* and 18*b* and faces 19*a* and 19*b* of the burner box 16 form an unsealed but enclosed space which, as indicated in FIGS. 4A and 4B, is part of a common flow path for air in both the powered and atmospheric modes of operation of the gas range.

Figure 6:
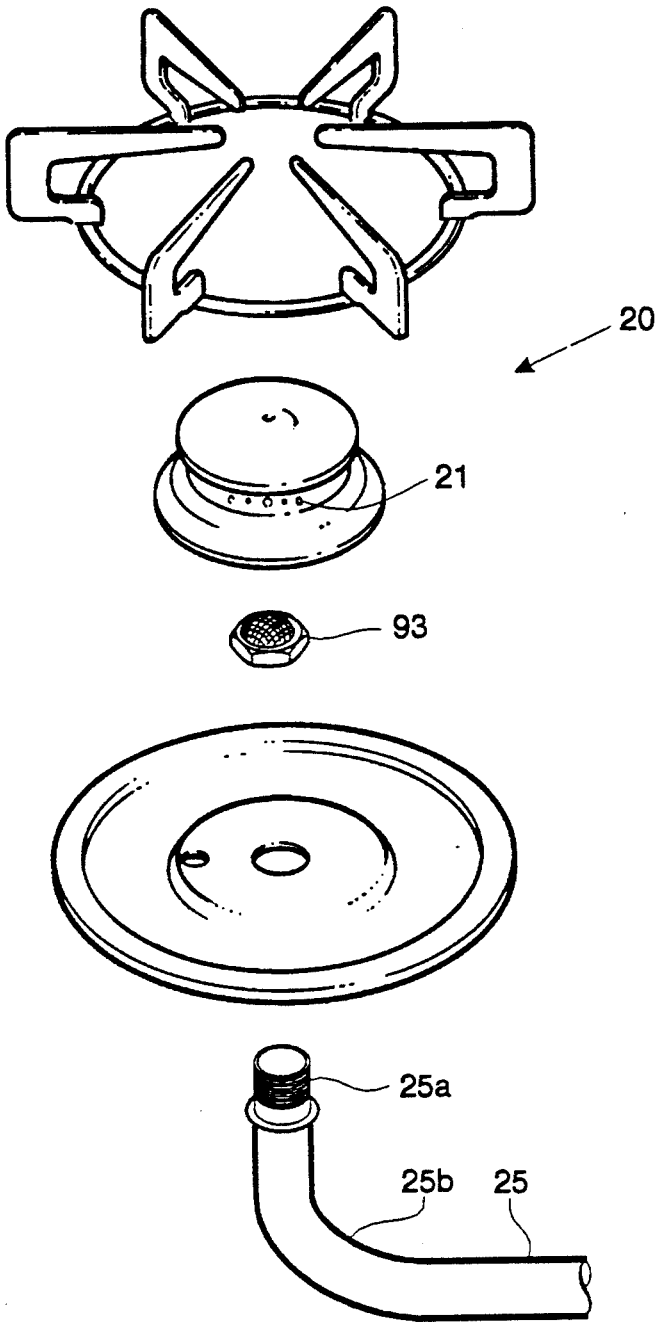
FIG. 6 is an exploded view of a sealed gas burner assembly of this invention.

As shown in FIGS. 2 and 4A, the combustion air blower 23 is carried by the burner box 16 adjacent its bottom 17, and the bottom 17 of the burner box 16 has an inlet opening 91 in communication with the inlet of the combustion air blower 23, as shown in FIG. 4A. As indicated in FIGS. 2 and 4A, the outlet 92 of the combustion air blower 23 communicates with the means forming the air plenum 34. When the combustion air blower 23 is operating, air is directed from its outlet 92 into the air plenum 34, and a first part of the air flows from air plenum 34, at an adjustable rate, through the air circulating opening 76 in the side 18*a* into the enclosed but unsealed space between the burner box 16 and the range top 11 and back to the inlet 91 of the combustion air blower 23, and because the air from combustion air blower 23 maintains the interior of air plenum 34 at an elevated pressure, which may be adjusted by shutter 75, primary combustion air will flow into the chambers 26 of the combined air and gas supply controllers 22 through their air flow control openings 36 and flow in a plurality of paths defined by the sealed conduits 25 to the sealed burner assemblies 20. It is preferred that each sealed burner assembly 20 include a diffuser 93 located between the sealed conduits 25 and the outlets 21 of the sealed burner assemblies 20, as shown in FIG. 6. Such a diffuser 93 is preferably a 32 mesh stainless steel screen carried by a threaded coupling that may be screwed onto the threaded end 25*a* of the sealed conduits 25. The diffusers 93 quiet burner operation in the powered mode and provide a more even distribution of the air-gas mixture from the burner outlets 21.

As shown in FIGS. 1 and 4B, in the atmospheric mode, with the combustion air blower 23, downdraft exhaust blower 14 and actuator 71 inoperative, primary combustion air flows from atmosphere through an air inlet opening 95 between the downdraft exhaust plenum 13 and the face 19*a* of burner box 16, through the enclosed but unsealed space between the range top 11 and burner box 16, through the plurality of gated openings 72 into the plurality of air-gas mixing chambers 26 formed in the injection boxes 51 for mixture with one or more flows of gas and flow in a plurality of paths through the sealed conduits 25 to the sealed burner assemblies 12. The gated openings 72 leading to the plenum-forming chambers 26 are relatively large, for example about $\frac{3}{4}$ inch by about 1 $\frac{3}{4}$ inch or about 1 to about 2 square inches in area, and bypass the air flow control restrictions used in the power mode. It is preferred that each sealed conduit 25 be formed, in its path between the combined air and gas supply controllers 22 and the sealed burner assemblies 12, to prevent abrupt changes in direction or other impediments to flow. Sealed conduits 25 must be bent to interconnect the gas burners 20 with their combined air and gas supply controllers 22 and are preferably formed, as shown in FIGS. 5A-5D and 6, so that each bend 25*b* in each conduit has a minimum radius of about one inch, and more preferably at least about 2 inches. Thus, the large gated openings 72 and smoothly bending, impediment-free sealed conduits 25 can provide an ample flow of primary combustion air to the sealed burner outlets 21 for combustion.

In the powered mode, a variable flow of gas for open flame cooking, at rates permitting a slow simmer as well as rapid searing, is combined with an accurate and controllable variable air flow at rates desirable for effective, substantially complete combustion of the gas with a substantially reduced need for secondary combustion air, and the accurately combined gas/air mixture is delivered to the burner outlets 21 through the sealed conduits 25, thereby preventing dilution and variation of the desired combustible mixtures, limiting the undesirable generation of CO and $NO_x$ and preventing operation of the downdraft exhaust from affecting the desired combustible mixture. The burner outlets or ports 21 of the standard burners preferred for use in the invention have standard diameters of about 0.05 to about 0.115 inch and preferably have a relatively long bore length having a substantial fraction of an inch, for example, about 0.312 to about 0.343 inch. The combination of such burner outlets 21 with relatively high air flow rates, providing, for example, a substantial percentage of the combustion air needed, improve burner operation. Orifices or ports formed with thin walls, such as 0.030 inch, are not preferred. Furthermore, the combination of a burner provided with gas flow and a desirable high percentage rate of air flow through a sealed conduit (thereby substantially reducing the burners need for secondary air) and an effective adjacent downdraft exhaust provides a household gas range which can substantially free the household of undesirable pollutants.

In the powered mode, a powered flow of combustion air and a gas flow are provided from within the burner outlets to form combusting gas/air jets with rapid and substantially complete combustion of the gas close to the burner outlets in short stable flames which are unaffected by the downdraft exhaust and other outside influences and provide even heat distribution around the burner. The resulting flames are believed to be impervious to the downdraft exhaust and other such outside influences because of the resulting "structural integrity" of the rapidly moving gas/air jet and its rapid, substantially complete combustion. For example, with the preferred burners and burner outlets described above, clean, sharp, stable flames can be obtained, providing even heat distribution as high as 10,000 BTUH with a gas pressure of about 5 inches of water column pressure above atmospheric pressure, and with an estimated primary air flow in excess of about 75 to 85 cubic feet per hour and preferably in excess of 85 cubic feet per hour.

In the atmospheric mode, a variable flow of gas for open flame cooking at rates permitting a slow simmer, as well as rapid searing, is combined with a substantially unrestricted flow of primary combustion air from atmosphere and delivered to the burner outlets 21 for combustion. Secondary air for combustion at the burner outlets is undisturbed by a downdraft exhaust. In preferred gas ranges of the invention, the flow of primary air from atmosphere bypasses the combustion air blower 23, the air plenum 34 and the air flow control plate 35 and opening 36 used in the powered mode to supply primary combustion air and is introduced directly into the chambers 26 through large gated openings 72 for direction through the smoothly contoured, sealed conduits 25 to the burner outlets 21.

The invention thus provides an effective method of dual mode cooking with a sealed gas burner by providing a controlled flow of cooking gas for mixing with a flow of primary combustion air and direction through a sealed conduit 25 to a plurality of outlets 21 of the sealed burner 20, with a powered mode of operation of the sealed burner 20 provided by a controlled forced flow of primary combustion air to a chamber 26 from a combustion air blower 23 through an air flow control plate 35 and opening 36 that is located between the combustion air blower 23 and the chamber 26, for mixing with the controlled flow of cooking gas and direction to the outlets 21 of the sealed burner 20 through the sealed conduit 25. An atmospheric mode of operation of the sealed burner 20 is provided by opening the chamber 26 to atmosphere and allowing a substantially unrestricted flow of air to enter the chamber 26 for mixing with the cooking gas and direction to the outlets 21 of the sealed burner 20 through the sealed conduits 25. Further, in a preferred method, the controlled and forced flow of primary combustion air and gas is diffused between the sealed conduit 25 and the outlets 21 of the sealed gas burner 20, and the flow of primary combustion air and gas is directed from the chamber 26 to the sealed burner 20 by a sealed conduit 25 free of flow impediments such as abruptly bending flow paths.

In addition, the method of the invention includes providing a downdraft exhaust adjacent the sealed burner 20 when operating in the powered mode and operation in the atmospheric mode without the downdraft exhaust, and the controlled forced flow of combustion air and gas is preferably provided to the outlets 21 of the sealed burner 20 before a significant exhaust draft is effected adjacent the sealed burners 20.

In one example of the invention in the powered mode, it was found that heat was evenly distributed to a 10 inch black cast-iron skillet, permitting pancakes to be cooked quickly with even doneness on all portions of the skillet in the presence of a downdraft exhaust through an exhaust opening adjacent the gas burner at a downdraft flow rate of approximately 300 cubic feet per minute throughout the system and a velocity of 1,400 feet per minute at the exhaust opening. The invention permitted the obtaining of clean, sharp, stable flames with approximately 10,000 BTUH output at not more than 5 inches of water pressure.

Thus, the invention provides a downdraft gas range with a number of substantial advantages including dual mode operation. The gas ranges of the invention can include a plurality of powered open flame surface burners providing even heat from each of the burners as a result of burner flames that provide substantially complete combustion close to the burner outlets in short, stable flames that are unaffected by an adjacent downdraft exhaust or other outside influences. The gas range of the invention can also operate in an atmospheric mode without a downdraft exhaust and meet agency requirements in both the powered mode and atmospheric mode of operation and can be inherently fail-safe in the event of a failure in the downdraft exhaust system. Furthermore, the invention permits a gas range with economically and easily manufactured and assembled burner controls arranged for convenient operation at one side of the range burner box for a plurality of burners.

While the description and drawings set forth the currently known best mode of the invention, other embodiments of the invention may be made without departing from the scope of the claims that follow. Accordingly, the invention is to be limited only by the scope of the claims and the prior art.

What is claimed is:

1. A dual mode gas range with a sealed range top, comprising:

a plurality of gas burners sealed to said range top;

a powered air source including a primary combustion air blower, and a pressurizable air plenum connected with said primary combustion air blower;

a combined air/gas supply controller comprising a plurality of chambers, each said chamber providing gas and primary combustion air for one of said plurality of gas burners;

a plurality of sealed conduits, each said sealed conduit connecting one of said chambers to one of said gas burners;

each said chamber of said combined air/gas supply controller having an air/gas outlet in communication with one of the sealed conduits, an air flow control inlet opening in communication with said pressurizable air plenum, and an atmospheric air inlet opening in communication with atmosphere;

said combined air/gas supply controller further comprising for each said chamber, a gas valve, an air flow control plate carried adjacent said air flow control inlet opening and a common operator for said gas valve and said air flow control plate for providing a combined control of air from said pressurizable air plenum and gas from said gas valve to said chamber;

said combined air/gas supply controller still further comprising for each said chamber an air gate operable to close or open said atmospheric air inlet opening of said chamber; and a system for operating said plurality of gas burners, said system operating said air gate for closing said atmospheric air inlet openings of said plurality of chambers and operating said primary combustion air blower in a power burner mode, and operating said air gate for opening said atmospheric air inlet opening to atmosphere in non-powered operation of said gas burners.

2. The gas range of claim 1 wherein each said chamber of said combined air/gas supply controller is mounted within said pressurizable air plenum.

3. The gas range of claim 2 wherein each said chamber is formed in one or more injection boxes.

4. The gas range of claim 3 wherein said pressurizable air plenum is formed by one side of a burner box carrying said sealed range top and said plurality of gas burners, and wherein each injection box is formed with at least one said chamber having an open face adapted for sealed engagement with said one side of the burner box, and said one side of the burner box is provided with an atmospheric air inlet opening for each said chamber.

5. The gas range of claim 4 wherein each injection box carries, opposite its open face, a gas valve which carries, within its associated chamber, an air/gas injection mixer.

6. The gas range of claim 4 wherein said burner box carries one or more air gates for said atmospheric air inlet openings in said one side of the burner box.

7. The gas range of claim 4 wherein said one or more injection boxes are provided at their sides with surfaces permitting a plurality of injection boxes to be assembled in line for attachment to said one side of the burner box, said plurality of atmospheric air inlet openings in one side of the burner box being provided in line, one for each chamber, said burner box carrying a single air gate for closing the plurality of atmospheric air inlet openings.

8. The gas range of claim 4 wherein said one side of said burner box includes an opening between said pressurizable air plenum and said burner box and carries a slidable shutter adjacent the opening for adjustably closing the opening to adjust the pressurization of the air plenum.

9. The gas range of claim 3 wherein each said injection box has a top opening to its chamber and a tongue and groove portion formed at each side of the top opening, and said air flow control inlet opening is formed in a plate adapted to be inserted into and retained in the tongue and groove portions of said injector box, thereby closing the top opening of the chamber except for said air flow control inlet opening.

10. The gas range of claim 2 wherein each of said chambers has a volume of from about 5 to about 10 cubic inches.

11. The gas range of claim 1 further comprising a downdraft exhaust located adjacent said plurality of gas burners and a downdraft exhaust blower, and wherein said system operates said downdraft exhaust blower during operation of said primary combustion air blower.

12. The gas range of claim 1 wherein each of said gas burners includes a diffuser between its burner outlets and its sealed conduit.

13. The gas range of claim 1 wherein each sealed conduit provides a passageway having minimum radii of curvature of at least one inch.

14. The gas range of claim 1 wherein said pressurizable air plenum has an adjustable opening for permitting adjustment of the pressurization of the air plenum.

15. The gas range of claim 1 wherein said air gate is operated to move slowly between open and closed positions.

16. A dual mode gas range, comprising:

an open top burner box, formed by a bottom, two sides and two faces, a range top connected to the open top of the burner box, and a plurality of gas burners sealed to the range top to provide a sealed top gas range assembly forming an enclosed but unsealed space between the range top and burner box;

a combined air/gas supply to supply gas and primary combustion air to said plurality of gas burners through a plurality of sealed conduits, said combined air/gas supply comprising an air plenum formed by one side of said burner box and a blower having its inlet in communication with an opening formed in the bottom of said burner box and its outlet in communication with said air plenum, said one side of said burner box that forms said air plenum including a circulating air opening communicating with said enclosed but unsealed space formed by the range top and the bottom, sides and faces of said burner box, said air plenum and said enclosed but unsealed space comprising a path for circulating air flow generated by said blower;

a plurality of other air flow paths for primary combustion air from said blower, each of said plurality of other air flow paths including said air plenum, said sealed conduits and said gas burners; and an adjustable shutter carried adjacent to said circulating air opening between said air plenum and said enclosed but unsealed space, said adjustable shutter providing adjustment of the air pressure within said air plenum that is available to direct primary combustion air flow through said plurality of other air flow paths.

17. The dual mode range of claim 16 wherein said one side of said burner box includes a plurality of gated openings between said enclosed but unsealed space and said plurality of other air flow paths, one gated opening for each of said plurality of other air flow paths, and wherein said burner box carries an air gate for closing said plurality of gated openings with operation of said blower and otherwise leaving said plurality of gated openings unobstructed to a flow of air from said enclosed but unsealed space into each of said plurality of other flow paths.

18. The dual mode gas range of claim 16 wherein each of said sealed conduits of said plurality of other air flow paths has minimum radii of curvature of from greater than about an inch to about several inches throughout, and said dual mode gas range further comprises a plurality of diffusers, one between each of said sealed conduits and its connected gas burner.

19. The dual mode gas range of claim 16 further comprising:

an opening in said range top connecting said enclosed but unsealed space formed by said range top and the bottom, sides and faces of said burner box to atmosphere;

an atmospheric air inlet opening between said enclosed but unsealed space and each of said sealed conduits; and at least one air gate operable between a first position closing each of the atmospheric air inlet openings and a second position leaving each of the atmospheric air inlet openings unobstructed.

20. A dual mode downdraft range comprising:

an open top burner box formed by a bottom, two sides and two faces;

a downdraft plenum extending through the bottom of said burner box, said downdraft plenum extending partially between said two faces;

a downdraft exhaust blower;

a range top connected to the open top of said burner box and providing a space between said burner box and range top;

a plurality of gas burners sealed to the range top, said range top, burner box and downdraft plenum providing a sealed top gas range assembly, said range top providing an exhaust opening into said downdraft plenum and an atmospheric air opening into the space between said burner box and range top;

an air/gas supply for supplying gas and primary combustion air to the plurality of gas burners through a plurality of air/gas chambers connected with a plurality of sealed conduits;

said air/gas supply further comprising a combustion air blower having its inlet in communication with an opening formed in the bottom of said burner box and its outlet in communication with an air plenum located at and formed by one side of said burner box;

said one side of said burner box forming said air plenum including a circulating air opening communicating with the space formed between said range top and said burner box and further including a plurality of gated openings, each of said gated openings communicating with said space between said burner box and range top and one of said air/gas chambers;

an air gate operable to open and close said gated openings;

a control for operating said range in a power burner mode by operating said combustion air blower, said downdraft exhaust blower and said air gate to close said gated openings, said air plenum and space comprising one path for air flow generated by said combustion air blower, and a plurality of other air flow paths for primary combustion air flow from said combustion air blower and said air plenum being formed by said plurality of chambers, sealed conduits and gas burners; and an adjustable shutter carried adjacent to said circulating air opening between said air plenum and said space between said burner box and range top, said adjustable shutter adjustably varying the size of said circulating air opening to adjust said air plenum pressure available to direct primary combustion air flow through said plurality of other air flow paths, said gated openings being open when said range is not in the power burner mode to provide a flow path for primary combustion air from atmosphere through said atmospheric air opening in said range top, said space between said burner box and range top, and said plurality of chambers, sealed conduits and gas burners.

21. A downdraft gas range adapted to provide a gas burner with a powered flow of primary combustion air, comprising:

a cooktop comprising a top surface adapted to be connected to a sealed gas burner assembly;

a downdraft plenum adjacent said sealed gas burner assembly for withdrawing combustion byproducts and cooking vapors from adjacent said top surface and sealed gas burner assembly;

said sealed gas burner assembly comprising a gas burner having a plurality of burner outlets;

a combined air and gas flow supply, including an air mover for providing air flow at pressures above atmospheric pressure in the presence of a downdraft exhaust, and a gas flow source;

a sealed conduit connected between said sealed gas burner assembly and said combined air and gas flow supply for delivering a combined flow of primary combustion air and gas from said air mover and gas flow source; and a diffuser between said gas burner and said sealed conduit to diffuse the flow of gas and air.

22. The downdraft gas range of claim 21 wherein said diffuser is a 32 mesh screen.

23. The downdraft gas range of claim 21 wherein said sealed conduit has minimum radii of curvature greater than about one to about two inches and carries a mesh screen diffuser at its end adjacent said gas burner.

24. A downdraft gas range with a sealed top, comprising:

at least one sealed gas burner assembly carried by said sealed top and comprising a gas burner and a connected sealed conduit;

a downdraft exhaust system adjacent said gas burner comprising a downdraft plenum connected with an exhaust blower;

a combined air and gas supply controller connected with said sealed conduit, said combined air and gas supply controller comprising a chamber for housing an air-gas mixer, said chamber being connectable through a gas flow control valve with a source of gas under pressure and through an air flow control valve with a combustion air blower and having a gated opening communicating with atmosphere; and a control for operation of said gas range, said gas range control including electrical switches to operate said combustion air and exhaust blowers and to close said gated opening of the combined air and gas supply controller for operation in a powered burner mode and to prevent operation of said combustion air and exhaust blowers and open said gated opening of the combined air and gas supply controller in an atmospheric burner mode.

25. The downdraft gas range of claim 24 further comprising an air plenum connected with said combustion air blower, said chamber of said combined air and gas supply controller being carried within said air plenum.

26. The downdraft gas range of claim 25 wherein said air plenum is formed on one side, by one side of a burner box carrying said sealed top and sealed burner assembly, and wherein said chamber is formed in part by said one side of said burner box, and said one side of said burner box includes said gated opening and an opening permitting communication between said air-gas mixer and said sealed conduit.

27. The downdraft gas range of claim 26 wherein said one side of said burner box also includes an opening into said air plenum and carries an adjustably mounted shutter adjacent said opening for adjustment of the air pressure within said air plenum.

28. The downdraft gas range of claim 24 wherein said gated opening is operated slowly in response to said control in opening and closing said chamber to atmosphere.

29. Means forming a combined air and gas supply controller for a dual mode gas range, comprising:

an open faced injection box carried by a surface of said dual mode gas range and including a back and four sides with a seal carried by said injection box around the open face to cooperate with said surface of said dual mode gas range to form a chamber, said chamber having dimensions to house an air-gas injection mixer and having one of said sides forming an air flow control opening.

30. The means of claim 29 wherein said injection box forms an opening to carry, opposite its open face, a gas flow control valve and within its chamber an air/gas injection mixer.

31. The means of claim 29 wherein said injection box is provided at its outer sides with surfaces permitting a plurality of injection boxes to be assembled in line for attachment to said dual mode gas range.

32. The means of claim 29 wherein said injection box has a large air opening to its chamber on one side and tongue and groove portions formed at each side of said large air opening, and an air control plate forming a smaller air flow control opening and with sides formed to be inserted into and retained in the tongue and groove portions of the injector box, thereby closing the large air opening of the chamber except for the air flow control inlet opening.

33. The means of claim 29 wherein said injection box forms a chamber with a volume in the range of from about 5 to about 10 cubic inches.

34. A method of dual mode cooking with a sealed gas burner, comprising:

providing a controlled flow of cooking gas to an injection chamber for mixing with a flow of primary combustion air and for direction through a sealed conduit to a plurality of outlets of the sealed burner;

providing a powered mode of operation of the sealed burner by providing a controlled, forced flow of primary combustion air to the injection chamber from a combustion air blower through an air flow control valve located between the combustion air blower and the injection chamber for mixing with the controlled flow of cooking gas and direction to the outlets of the sealed burner through the sealed conduit; and providing an atmospheric mode of operation of the sealed burner by opening the injection chamber to atmosphere and allowing a substantially unobstructed flow of air to enter the injection chamber for mixing with the cooking gas and direction to the outlets of the sealed burner through the sealed conduit.

35. The method of claim 34 wherein the controlled and forced flow of primary combustion air and gas is diffused between the sealed conduit and the outlets of the sealed gas burner.

36. The method of claim 34 wherein the flow of primary combustion air and gas is directed from the mixing chamber to the sealed burner by a sealed conduit that is free of obstructions to flow.

37. The method of claim 35 wherein the controlled and forced flow of primary air is diffused by a mesh screen.

38. The method of claim 34 further comprising:

providing a downdraft exhaust adjacent the sealed burner when operating in the powered mode and disabling the downdraft exhaust when operating in the atmospheric mode.

39. The method of claim 34 wherein the controlled forced flow of combustion air and gas is provided to the outlets of the sealed burner before the exhaust is effected adjacent the sealed burner.

40. In a dual mode cooking apparatus with a sealed burner including a flow path for a controlled powered flow of primary combustion air to one or more chambers for mixing with one or more controlled flows of gas, one or more sealed flow paths for the one or more resulting flows of mixed primary combustion air and gas, each of the one or more sealed flow paths extending between one of the chambers and one of the sealed burners, the improvement comprising controllable means for opening the one or more chambers to a substantially unrestricted flow of atmosphere primary combustion air in the absence of a controlled powered flow of primary combustion air.

41. The apparatus of claim 40 wherein said means for opening the one or more chambers comprises a gated opening for atmospheric air in communication with each of the one or more chambers, one or more air gates operable between positions opening and closing the one or more gated openings, and a slow-acting linear actuator for the one or more air gates.

42. In a dual mode cooking apparatus with a sealed burner including a flow path for a controlled powered flow of primary combustion air to one or more chambers for mixing with one or more controlled flows of gas, one or more sealed flow paths for the one or more resulting flows of mixed primary combustion air and gas, each of the one or more sealed flow paths extending between one of the chambers and one of the sealed burners, the improvement comprising gated openings for atmospheric air in communication with the one or more of the chambers, one or more air gates operable between positions opening and closing the one or more gated openings, and a slow-acting linear actuator for the one or more air gates for providing one or more substantially unrestricted flows of primary combustion air to the one or more chambers in the absence of a controlled powered flow of primary combustion air.

* * * * *

UNITED STATES PATENT AND TRADEMARK OFFICE

CERTIFICATE OF CORRECTION

PATENT NO. : 5,325,842

DATED : July 5, 1994

INVENTOR(S) : Stanley H. Beach et al

It is certified that error appears in the above-identified patent and that said Letters Patent is hereby corrected as shown below:

Col. 20, line 41 before "means" insert -- controllable --

Signed and Sealed this

Twenty-fifth Day of April, 1995

Bruce Lehman

*Attest:*

BRUCE LEHMAN

*Attesting Officer*

*Commissioner of Patents and Trademarks*